United States Patent [19]

Halbardier

[11] Patent Number: 4,655,292

[45] Date of Patent: Apr. 7, 1987

[54] STEAM INJECTION PACKER ACTUATOR AND METHOD

[75] Inventor: Floyd A. Halbardier, Pasadena, Tex.

[73] Assignee: Baker Oil Tools, Inc., Orange, Calif.

[21] Appl. No.: 886,012

[22] Filed: Jul. 16, 1986

[51] Int. Cl.[4] ..... E21B 23/06; E21B 33/127

[52] U.S. Cl. ..... 166/387; 166/53; 166/187

[58] Field of Search ..... 166/387, 187, 53, 182, 166/120

[56] References Cited

U.S. PATENT DOCUMENTS

| | | | |
|---|---|---|---|
| 4,260,164 | 4/1981 | Baker et al. | 166/187 X |
| 4,527,625 | 7/1985 | Wood et al. | 166/187 |
| 4,589,484 | 5/1986 | Doherty et al. | 166/187 X |

FOREIGN PATENT DOCUMENTS

| | | | |
|---|---|---|---|
| 1113514 | 9/1984 | U.S.S.R. | 166/120 |

*Primary Examiner*—James A. Leppink
*Assistant Examiner*—Hoang C. Dang
*Attorney, Agent, or Firm*—Norvell & Associates

[57] ABSTRACT

An actuating assembly for a single set production-injection packer and a method of operation are provided for use in variable temperature downhole environments, such as are encountered in steam injection processes for petroleum recovery operations. After the packer is set, a compensator allows for fluid volume increase or decrease of the packer fluid chamber to maintain the proper packer inflation pressure. A piston-type accumulator with a preselected nitrogen load prevents rupture of the packer by compressing the nitrogen load while further expanding the fluid chamber for the packer fluid should the inflation pressure rise above a selected level. The packer may be unset by axially raising the tubing with respect to the set packer to open the packer fluid to downhole pressure.

20 Claims, 4 Drawing Figures

STEAM INJECTION PACKER ACTUATOR AND METHOD

FIELD OF THE INVENTION

The present invention relates to methods and apparatus for operating a hydraulic packer and, more particularly, relates to methods and apparatus for operating a single set production-injection packer in a downhole variable temperature environment.

BACKGROUND OF THE INVENTION

Single set production-injection packers operated by hydraulic fluid pressure are well known in the art, with an exemplary packer described in U.S. Pat. No. 4,349,204, hereby incorporated by reference. In many downhole environments, such packers and the actuator or setting mechanisms may be reliably utilized for conventional hydrocarbon recovery operations.

In other situations, such as recovery operations in California involving heavy crude, the high viscosity crude is recovered by injecting high-temperature/high-pressure steam with additives into the well. The packer enables steam to be injected through the packer and into the formation while sealing the annulus between the tubing and casing. The packer then holds pressure within the formation as the steam migrates into the formation to enhance the recovery operation.

When prior art packers and setting assemblies are utilized in such environments, the fluid pressure in the packer rises with the injection of steam and the resultant increase in packer temperature. During the soak operation, the formation absorbs steam and the temperature decreases in the area adjacent the packer, causing a corresponding decrease in the packer fluid pressure. When utilizing a hydraulic packer in such situations, difficulties are thus encountered in effectively maintaining sealed engagement with the tubing and the casing and, accordingly, either a mechanical packer is utilized or the hydraulic packer is reset at various times during the hydrocarbon recovery operation by altering packer fluid pressure from the surface. A mechanical packer may, however, not be preferred in such situations, and the latter technique involves additional time and labor.

SUMMARY OF THE INVENTION

A setting assembly for a single set production-injection packer is provided for use in steam injection operations. The packer may be set by pumping fluid down the tubing, with a shear plug releasing fluid pressure at a selected level and maintaining the packer set in the well. After the petroleum recovery operation is complete, or if desired during an intermediate stage, the packer may be unset by axially raising the tubing string so as to open a passageway between the packer fluid and the downhole environment.

After the packer is set, a piston-type compensator allows for expansion of the packer fluid chamber in order to keep the packer fluid pressure from rising above a selected value in response to an increase in temperature caused by steam injection. Moreover, this same compensator enables the packer fluid chamber to decrease in order to maintain at least a selected fluid pressure in the packer as the steam enters the formation and the temperature decreases. A compensator piston is sized so that the packer pressure is a selected percentage of the downhole fluid pressure.

In the event that the compensator piston bottoms out due to an increase in temperature, the packer fluid pressure may rise to a level equal to the preselected level in the accumulator. An increase in packer pressure above the preselected accumulator pressure will result in movement of the accumulator piston, thereby further increasing the packer fluid chamber to maintain the packer fluid at a safe pressure level, while further compressing the nitrogen in the accumulator.

As the pressure drops, the increased accumulator pressure will first move the accumulator piston to its original position, and thereby maintain pressure in the packer at a level sufficient to maintain the packer set. As the temperature further decreases, the compensator piston will move to further contract the packer fluid chamber. The fluid chambers are thus sized so that the packer remains set during extreme temperature variations, while never exposing the packer to a pressure level sufficiently high to cause failure.

DETAILED DESCRIPTION OF THE PREFERRED EMBODIMENT

Figure 1A:
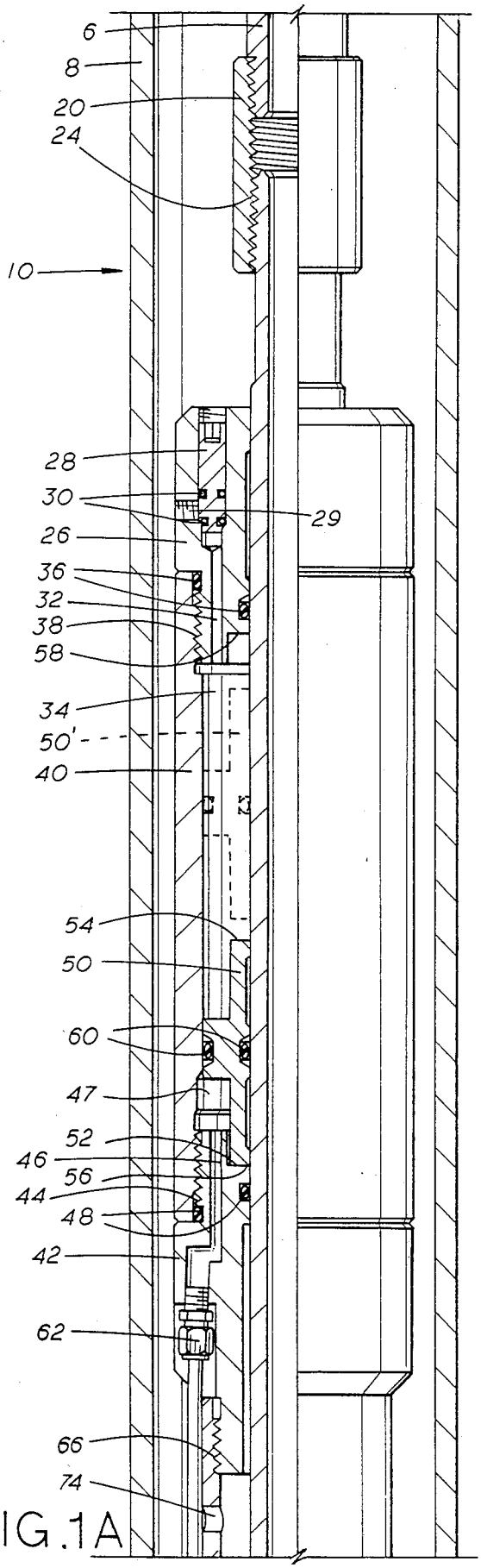
FIGS. 1A, 1B and 1C are simplified elevated views, partially in cross-section, of the packer actuator assembly and packer according to the present invention.
Figure 1B:
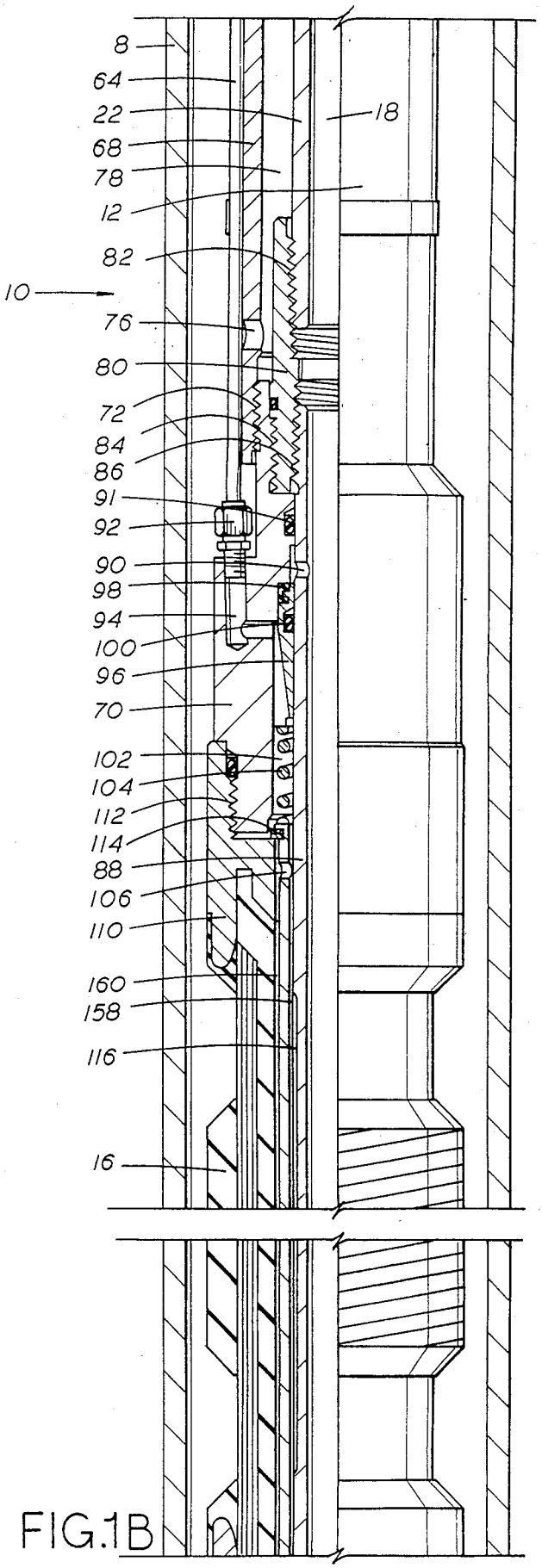
Figure 1C:
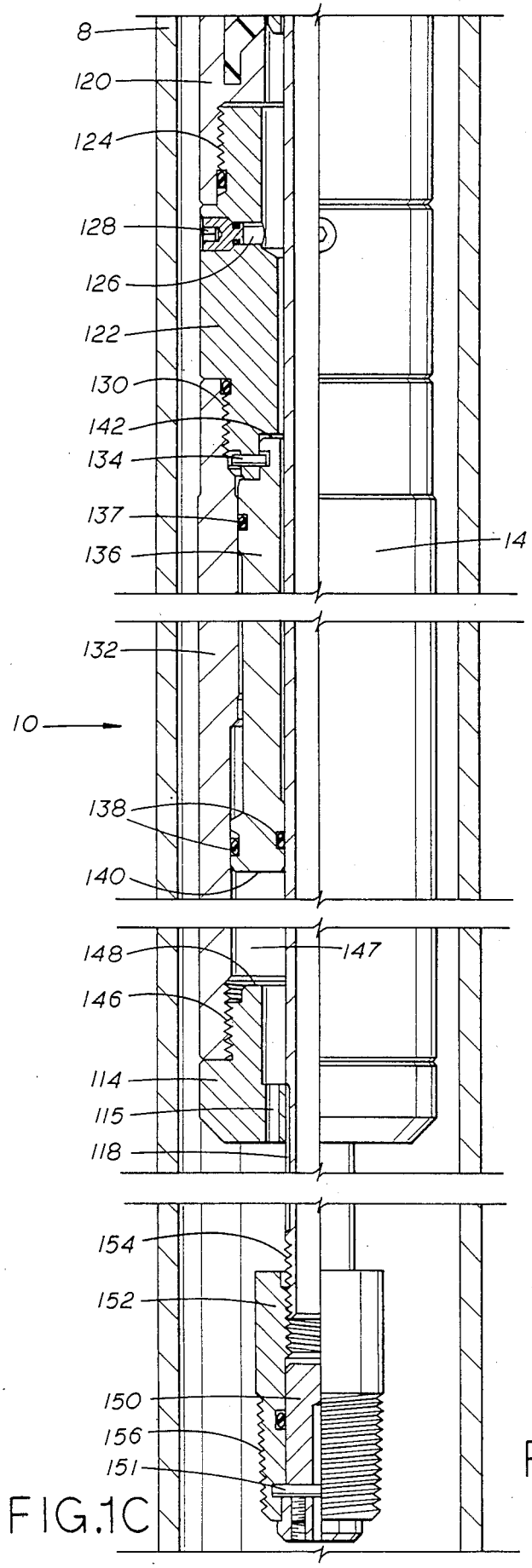

FIGS. 1A, 1B, and 1C depict a packer actuating assembly 10 comprising an upper subassembly 12 and a lower subassembly 14 suitable for setting and unsetting a hydraulic packer 16 in a subterranean petroleum recovery well. The assembly 10 and packer 16 include a continuous central passageway 18 having a typical internal diameter of approximately 2 inches for subsequent injection beneath the set packer. The actuator assembly and packer 16 are preferrably adapted for use in steam injection wells subjected to various temperatures, and may accommodate subterranean pressures and temperatures in the range of up to 5000 p.s.i. and 500° F.

Assembly 10 and packer 16 may be conventionally supported by a tubing string 6 and positioned at their desired depth within casing 8. A standard tubing collar 20 with threads 24 interconnects the tubing 6 to the tubular mandrel 22, which in turn is connected at its other end to collar 80 and mandrel 88. Upper sub 26 includes a fill valve 28 in sealing relationship thereto via seals 30, and also includes a passageway 32 for transporting a selected fluid, e.g. nitrogen, to the nitrogen chamber. Nitrogen chamber 34 is formed in the annulus between tubular mandrel 22 and housing 40, which is threaded at 38 for engagement with sub 26. A fluid-tight connection between 26 and both 22 and 40 is made with standard seals 36.

A slidable piston 50 defines the opposite end of the nitrogen chamber 34, and is in sealing engagement with both 22 and 40 via seals 60 carried by the piston. The lower surface 52 of the piston is shown in FIG. 1A in engagement with stop surface 56 of the intermediate sub 42, so that in FIG. 1A nitrogen chamber 34 is at its maximum volume. When at its minimum volume, which would rarely if ever occur as explained subsequently, the stop surface 54 of piston 50 would be in engagement with stop surface 58 of the upper sub 26. Seals 48 provide a fluid-tight seal between the intermediate sub 42 and both 22 and 40.

Intermediate sub 42 is threaded at 44 for engagement with housing 40, and includes a passageway 46 in fluid communication with chamber 47 beneath the piston 50. A standard connection 62 provides fluid-tight communication between passageway 46 and line 64. Intermediate sub 42 is threaded at 66 for engagement with spacer housing 68, which in turn is threaded at 72 for engagement with check valve sub 70. Spacer housing 68 includes through ports 74 and 76 enabling cavity 78 to be open to downhole fluid pressure.

Collar 80 is threaded at 82 for engagement with tubular mandrel 22, at 84 for engagement with check valve sub 70, and at 86 for engagement with elongate mandrel 88. Check valve sub 70 includes passageway 94 in fluid communication with line 64 via connection 92. Check valve 96 is provided between sub 70 and mandrel 88, and contains sliding seal 100 for engagement with 88, and seal 98 for engagement with sub 70 when the valve is in the closed position. The port 90 in member 88 allows fluid pressure in central passageway 18 to act on the check valve 96, pushing the check valve down against spring 104. Fluid in passageway 94 bypasses the check valve and flows through passageway 102 to passageways 158 and 160. Seal 91 maintains fluid-tight engagement between sub 70 and the upper portion of mandrel 88.

Upper packer sub 110 is threaded at 112 for engagement with check valve sub 70. A tubular protector 106 is positioned in engagement with packer sub 110 by a standard retainer ring 114, and includes one or more ports enabling either passageway 158 or 160 to pass fluid to the lower piston 136. A plurality of upper slots 116 in mandrel 88 allow for unsetting of the packer, as described subsequently.

Lower packer sub 120 is connected to compensator adapter sub 122 via threads 124, and includes passageway 126 closed by threaded plug 128. Outer housing 132 is connected to sub 122 by threads 130, while slidable piston 136 is secured in its upper position to sub 122 via shear pin 134. Seals 137 and 138 maintain both static and dynamic sealing engagement between piston 136 and 132 and 88, respectively.

The upper surface 142 of piston 136 is exposed to fluid pressure in passageways 158 and 160, while the larger area lower surface 140 of the piston is exposed to downhole fluid pressure via port 115 or passageway 118. Cap 114 is threaded at 146 for engagement with 132, and contains a stop surface 148 for engagement with 140 when the piston 136 is in its lowermost position. The lower end of mandrel 88 contains threads 154 for engagement with collar 152, which in turn includes conventional threads 156 for receiving, if desired, another downhole component, such as a tail-pipe or plug catcher. Blowout plug 150 is connected to collar 152 by shear pin 151.

The packer 16 may be set against the casing 8 by pumping a selected fluid from the surface through tubing 6 and passageway 18 to the inflatable members in the packer. Fluid pressure in passageway 18 passes through port 90 and acts upon the check valve 96, forcing of the check valve downward against the spring 104 and enabling the packer setting fluid to pass by the seal 98, into the chamber 102, through the passageways 158 and 160 and to the packer inflation member. The packer inflates and sets against the well until the desired packer injection pressure is obtained.

Once the preselected packing setting pressure, e.g. 900 psi, is obtained, pin 151 shears, blowing out the plug 150. Once the plug blows, the decreasing fluid pressure and spring 104 cause check valve 96 to move upward, with seals 98 and 100 seating in the closed position to trap the packer inflation fluid under pressure in the packer and passageways 158 and 160. With the packer set in the well, steam at, e.g. 450° F. and 500 psi, may then be injected from the surface into the formation for the soak operation, raising the bottom hole pressure substantially from the pre-steam injection level.

As steam passes through passageway 18 and into the formation, the downhole pressure beneath the packer, and therefore the pressure in cavity 147 beneath piston 136, rises. This increase in formation temperature and pressure also increases the temperature and, therefore, the pressure in the inflatable members of the packer 16, the passageways 158 and 160, and the pressure acting on the top surface 142 of piston 136. When the packer inflation pressure rises to a preselected level, e.g., 1100 psi, plus a selected multiple, e.g. 1.25, of the injection pressure acting on the lower surface 140 of the piston 136, the pin 134 will shear, allowing piston 136 to increase the effective volume of the packer fluid chamber in the apparatus 10 and the packer 16, while simulataneously decreasing the volume of compensator chamber 147.

Once the pin 134 has sheared, compensator piston 136 will move within apparatus 10 in order to maintain the inflation pressure in the packer at the preselected value, e.g. 1.25, times the injection pressure. An increase in steam injection pressure will, therefore, cause the piston 136 to rise upward, increasing the inflation pressure proportionately. When the increased temperature of the inflation fluid raises the inflation pressure to a value exceeding 1.25 times the injection pressure, the compensator piston 136 will have moved downward until the piston 136 bottoms out with surface 140 and engagement with stop surface 148. At this stage, the increase in inflation pressure due to continued steam injection overcomes the compensation ratio and the increased downhole pressure, and the inflation pressure is equal to or more than 1.25 times the downhole pressure.

Continued steam injection and the resultant increase in injection fluid temperature will thereafter raise the inflation pressure until it is equal to the preselected pressure in the accumulator pressure 34. An additional volume increase of the inflation fluid will, therefore, be absorbed by the accumulator piston 50 and the increase in pressure of the accumulator gas to prevent overpressuring and rupturing of the inflatable packer element. FIG. 1A depicts the piston 50' in a typical position with the nitrogen in the chamber 34 further compressed by upward movement of the piston 50'. Since the minimum volume of the inflation pressure chamber is fixed, an ever-increasing inflation pressure will be required to cause additional upward movement of piston 50. As explained subsequently, the components of the present invention are sized so that the piston 50 will likely not top out against stop surface 58.

When steam injection has stopped and the well is shut in for the soak operation, the formation temperature slowly drops, and the piston 50 will again move down to the initial position shown in FIG. 1A, returning the injection fluid to a desired level. As the formation temperature continues to drop and the inflation pressure decreases, the compensator piston 136 will move upward in response to the bottom hole pressure, again maintaining the packer in the set position.

Figure 2:
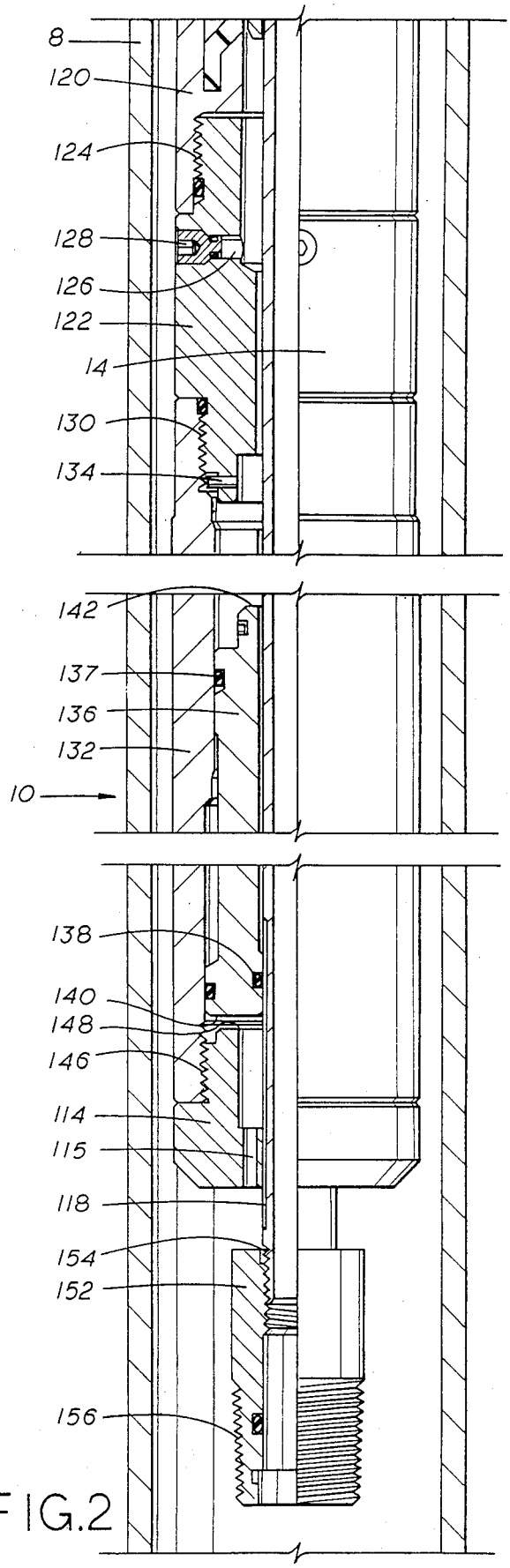
FIG. 2 is an elevated view, partially in cross-section, showing a portion of the apparatus depicted in FIG. 1 in a position to unset the packer.

In order to unset the packer, the tool string 6 may be turned to the right approximately four turns while picking up on the tubing weight. This action will cause the unthreading of left-hand threads 84, allowing the mandrel 88 to move upward with respect to the packer 16. The inflation port 90 will first pass by the seal 91, equalizing the pressure in the tubing string to the downhole or annulus pressure. Additional axial movement of mandrel 88 with respect to the set packer 16 will cause elongate grooves 116 in mandrel 88 to pass by this seal 100, relieving the packer fluid to the internal passageway 18 and unsetting the packer. Alternatively or, for redundancy, grooves 118 may be provided in mandrel 88, and the above-described operation will also move grooves 118 upward with respect to the piston 136 (FIG. 2). Once the grooves 118 past the seals 136, injection fluid may also pass downward past the seal 136 and out into the well through the grooves 118, thereby unsetting the packer. The assembly 10 and the packer 16 may then be retrieved to the surface, with the compensator piston 136 remaining in the downward position.

The fluid volume within a typical hydraulic packer is within the range of from 40 to 70 cubic inches before inflation, while the fluid volume inside the packer when inflated is in the range of from 550 to 800 cubic inches. As previously mentioned, the compensator piston 136 establishes a differential pressure between the downhole pressure and the inflation pressure, and preferably holds the inflation pressure at between 1.1 to 1.4 times the downhole pressure. The compensator chamber 147 typically allows for an increase in inflation fluid volume of between 110 and 165 cubic inches, i.e., after the pin 134 shears, the packer setting fluid volume may be increased by this range until the piston 136 bottoms out on the stop surface 148. The accumulator chamber 34 typically has a precharged volume of between 200 and 270 cubic inches and, as explained above, this volume will decrease while increasing nitrogen pressure so as to prevent rupturing of the packer element.

The accumulator chamber is precharged at the surface to a selected pressure level related to the surface temperature and the maximum anticipated injection temperature. Suitable accumulator chamber charging pressures for nitrogen gas charge at various surface temperature and injection temperature values follow:

| Max. Injection Temperature | Surface Temperature Range, Deg. F. | | | | | |
|---|---|---|---|---|---|---|
| | 26–40 | 41–55 | 56–70 | 71–85 | 86–100 | 101–115 |
| 150 Deg. F. | 2525 | 2600 | 2675 | 2750 | 2825 | 2900 |
| 200 Deg. F. | 2325 | 2400 | 2475 | 2550 | 2625 | 2700 |
| 250 Deg. F. | 2170 | 2235 | 2300 | 2365 | 2430 | 2500 |
| 300 Deg. F. | 2030 | 2090 | 2150 | 2210 | 2270 | 2330 |
| 350 Deg. F. | 1900 | 1955 | 2015 | 2075 | 2135 | 2195 |
| 400 Deg. F. | 1800 | 1850 | 1900 | 1950 | 2000 | 2050 |
| 450 Deg. F. | 1700 | 1750 | 1800 | 1850 | 1900 | 1950 |
| 500 Deg. F. | 1600 | 1650 | 1700 | 1750 | 1800 | 1850 |
| | Accumulator Charging Pressure, PSI | | | | | |

The nitrogen chamber 34 may be charged by connecting a suitable nitrogen fill line (not shown) to the tapped hole 29 in top sub 26, with fill valve 28 partially unthreaded to allow nitrogen to pass by the seals 30 and through passageway 32. Once pressurized to its desired level, the fill valve 28 is threaded closed so that the seals 30 retain nitrogen pressure in the chamber 34 and the fill line may then be removed.

The apparatus 10 and packer 16 may be run into a typical well at moderate speed, filling the tubing interior, if necessary, to prevent collapse. When the desired setting depth is obtained, fluid may be pumped through the tubing to inflate the packer, as previously described.

When the apparatus 10 is recovered from the well, the nitrogen chamber may be bled by threading a standard needle valve (not shown) into the threads about port 29. The plug valve 28 may then be backed out slowly and the needle valve opened. The apparatus may then be disassembled, the seals replaced, if necessary, the components cleaned, and reassembled for subsequent use. After reassembly, the apparatus may be pretested at the surface before rerunning in a subterranean well. During the testing of the apparatus, the pressure in the nitrogen chamber will rise linearly due to a temperature increase.

Although the invention has been described in terms of specified embodiments which are set forth in detail, it should be understood that this is by illustration only, and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Downhole apparatus for controlling fluid pressure in a hydraulic packer actuatable from the surface by injecting fluid at a packer actuating pressure sufficient to set the packer in a subterranean petroleum recovery well subjected to temperature variations, comprising:

said downhole apparatus including a first fluid chamber in fluid communication with the hydraulic packer for housing a portion of the fluid;

closure means for automatically sealing the fluid in the first fluid chamber from downhole fluid exterior to the apparatus;

fluid pressure compensator means including a second variable volume chamber and first movably responsive barrier means separating the first fluid chamber and the second chamber and movably responsive to the varying pressure of the fluid in the first chamber caused by the temperature variations for increasing the volume of the first chamber while decreasing the volume of the second chamber;

accumulator means including a third variable volume chamber for housing a compressible gas and second movable fluid barrier means separating the first fluid chamber and the third chamber and movably responsive to the varying pressure of the fluid in the first chamber caused by the temperature variations for preventing excessive fluid pressure in the first chamber by increasing the volume of the first chamber while compressing the gas in the third chamber; and pressure release means for releasing fluid pressure from the first chamber to unset the packer.

2. The downhole apparatus as defined in claim 1, wherein the closure means comprises a biased closure member for sealing the fluid in the first chamber.

3. The downhole apparatus as defined in claim 1, wherein the first movable fluid barrier means comprises:

a first slidable piston member; and shear means interconnected to the piston member for preventing movement of the slidable piston member until the pressure in the first chamber reaches a preselected value.

4. The downhole apparatus as defined in claim 1, wherein:

the first barrier means includes a first area exposed to fluid pressure in the first chamber and an opposing area exposed to downhole fluid pressure; and the opposing area is at least 110% greater than the first area for obtaining fluid pressure in the first chamber at a level functionally related to the downhole fluid pressure.

5. The downhole apparatus as defined in claim 1, wherein the third chamber is pressurized with the compressible gas when at the surface at a selected pressure level functionally related to anticipated downhole pressure and surface temperature conditions.

6. The downhole apparatus as defined in claim 1, wherein the second fluid barrier means comprises a second slidable piston member.

7. The downhole apparatus as defined in claim 5, wherein the selected pressure level of the compressible gas prohibits movement of the second barrier means until the first barrier means has at least substantially decreased the second variable volume chamber.

8. The downhole apparatus as defined in claim 6, wherein the volume of the third chamber is controlled solely by the movement of the second slidable piston member.

9. A method of maintaining desired pressure in a hydraulic packer actuated by fluid at a packer actuating pressure sufficient to set the packer in a subterranean petroleum recovery well subjected to temperature variations, the method comprising:

housing a portion of the fluid in a first downhole chamber in fluid communication with the hydraulic packer;

housing another fluid at least partially in a second downhole variable volume fluid chamber having a volume inversely related to varying pressure of the fluid in the first chamber caused by the temperature variations;

isolating the packer actuating fluid and the another fluid with a first movable fluid barrier between the first chamber and the second chamber;

housing a compressible gas in a third downhole variable volume chamber; and isolating the packer actuating fluid and the compressible gas with a second movable fluid barrier between the first chamber and the third chamber, the second fluid barrier being responsive to the varying pressure of the fluid in the first chamber caused by the temperature variations for preventing excessive fluid pressure in the first chamber by increasing the volume of the first chamber while compressing the compressible gas.

10. The method as defined in claim 9, further comprising:

restricting movement of the first movable barrier until at least a preselected pressure level greater than the packer actuating pressure is obtained in the first downhole fluid chamber.

11. The method as defined in claim 9, further comprising:

exposing said second chamber to downhole fluid pressure acting on the another fluid.

12. The method as defined in claim 11, wherein:

said first movable fluid barrier has a first surface and an opposing surface having a selected area greater than the first surface;

exposing the first surface to the fluid pressure the first chamber; and exposing the opposing surface to downhole fluid pressure.

13. The method as defined in claim 9, further comprising:

pressurizing the third chamber with a selected gas when at the surface at a selected pressure level funtionally related to anticipated downhole fluid pressure.

14. The method as defined in claim 13, wherein the selected gas pressure level is sufficient to prohibit substantial movement of the second fluid barrier until movement of said first barrier means is at least substantially prohibited.

15. The method as defined in claim 14, further comprising:

controlling the volume of the third chamber solely by movement of the second fluid barrier.

16. Downhole apparatus for actuating a hydraulic packer actuatable by fluid at a packer actuating pressure sufficient to set the packer in a subterranean petroleum recovery well subjected to temperature variations, comprising:

said downhole apparatus including a first fluid chamber in fluid communication with the hydraulic packer for housing a portion of the fluid;

biased closure means for automatically sealing the fluid in the first fluid chamber from downhole fluids exterior to the apparatus;

fluid pressure compensator means including a second variable volume chamber exposed to downhole fluid pressure and first movably responsive barrier means separating the first fluid chamber and the second chamber and movably responsive to the varying pressure of the fluid in the first chamber caused by the temperature variations for increasing the volume of the first chamber while decreasing the volume of the second chamber, the first barrier means having a first surface exposed to the fluid pressure in the first chamber and an opposing surface having an area greater than the first surface exposed to the downhole fluid pressure for maintaining the first fluid at a pressure level functionally related to the downhole fluid pressure;

accumulator means including a third variable volume chamber for housing a compressible gas and second movable fluid barrier means separating the first fluid chamber and the third chamber and movable responsive to the varying pressure of the fluid in the first chamber caused by the temperature variations for preventing excessive fluid pressure in the first chamber by increasing the volume of the first chamber while compressing the gas in the third chamber; and pressure release means for releasing fluid pressure from the first chamber to unset the packer.

17. The downhole apparatus as defined in claim 16, wherein the first movable fluid barrier means comprises:

a first slidable piston member; and shear means interconnected to the piston member for preventing movement of the slidable piston member until the pressure in the first chamber reaches a preselected value.

18. The downhole apparatus as defined in claim 16, wherein the third chamber is pressurized with the compressible gas when at the surface at a selected pressure level functionally related to anticipated downhole pressure and surface temperature conditions.

19. The downhole apparatus as defined in claim 18, wherein the selected pressure level of the compressible gas prohibits movement of the second barrier means until the first barrier means has at least substantially decreased the second variable volume chamber.

20. The downhole apparatus as defined in claim 16, wherein:

the second fluid barrier means comprises a second slidable piston member; and the volume of the third chamber is controlled solely by the movement of the second slidable piston member.

* * * * *